US012187496B2

(12) United States Patent
Ooka

(10) Patent No.: US 12,187,496 B2
(45) Date of Patent: Jan. 7, 2025

(54) PLASTIC CAP

(71) Applicant: NIPPON CLOSURES CO., LTD., Tokyo (JP)

(72) Inventor: Shinji Ooka, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 471 days.

(21) Appl. No.: 17/417,203

(22) PCT Filed: Feb. 10, 2020

(86) PCT No.: PCT/JP2020/005068
§ 371 (c)(1),
(2) Date: Jun. 22, 2021

(87) PCT Pub. No.: WO2020/175123
PCT Pub. Date: Sep. 3, 2020

(65) Prior Publication Data

US 2022/0073237 A1 Mar. 10, 2022

(30) Foreign Application Priority Data

Feb. 27, 2019 (JP) ..... 2019-033541

(51) Int. Cl.
*B65D 41/34* (2006.01)
*B65D 53/02* (2006.01)

(52) U.S. Cl.
CPC ..... *B65D 41/3428* (2013.01); *B65D 53/02* (2013.01); *B65D 2401/20* (2020.05)

(58) Field of Classification Search
CPC . B65D 41/3428; B65D 53/02; B65D 2401/20
See application file for complete search history.

(56) References Cited

U.S. PATENT DOCUMENTS 4,392,055 A * 7/1983 Whitney ..... B65D 41/0414 215/307
4,489,845 A * 12/1984 Aichinger ..... B65D 41/0421 215/DIG. 1

(Continued)

FOREIGN PATENT DOCUMENTS

EP 1 529 734 5/2005
GB 2467355 8/2010

(Continued)

OTHER PUBLICATIONS

International Search Report issued Apr. 21, 2020 in International (PCT) Application No. PCT/JP2020/005068.

(Continued)

*Primary Examiner* — James N Smalley
(74) *Attorney, Agent, or Firm* — Wenderoth, Lind & Ponack, L.L.P.

(57) ABSTRACT

A plastic cap is able to be applied to a container having a screw formed with a vent. The plastic cap has an outer ring for sealing at least the outer surface of the mouth of the container, and an inner ring for sealing the inner surface of the container mouth. In a closed state, sealability is maintained by a seal point on the inner surface of the outer ring. In an unsealing step, a seal point on the outer surface of the inner ring is shifted into a pressure-contacted state on the inner surface of the container mouth, where there is no risk of sink marks caused by molding strain, before a seal by the outer ring is released. Thus, reliable sealability can be exhibited even when the cap is applied to a container having inferior dimensional accuracy.

15 Claims, 4 Drawing Sheets

(56) References Cited

U.S. PATENT DOCUMENTS

| | | | | |
|---|---|---|---|---|
| 5,297,688 | A * | 3/1994 | Beck | B65D 41/0421 215/354 |
| 5,871,111 | A * | 2/1999 | Pfefferkorn | B65D 41/0421 215/354 |
| 6,325,226 | B1 * | 12/2001 | Krautkramer | B65D 41/0421 215/901 |
| 6,338,414 | B1 * | 1/2002 | Schellenbach | B65D 41/3447 215/354 |
| 6,779,672 | B2 | 8/2004 | Kano et al. | |
| 7,014,055 | B2 | 3/2006 | Kano et al. | |
| 2001/0027957 | A1 | 10/2001 | Kano | |
| 2003/0015490 | A1 | 1/2003 | Taha | |
| 2006/0138073 | A1 | 6/2006 | Ooka et al. | |
| 2007/0131641 | A1 | 6/2007 | Higgins | |

FOREIGN PATENT DOCUMENTS

| | | |
|---|---|---|
| GB | 2476089 | 6/2011 |
| JP | 2003-252353 | 9/2003 |
| JP | 2004-338789 | 12/2004 |
| JP | 2004-352360 | 12/2004 |
| JP | 4098797 | 6/2008 |
| JP | 2012-516272 | 7/2012 |
| JP | 2015-9853 | 1/2015 |
| KR | 10-2007-0052735 | 5/2007 |
| WO | 2014/077311 | 5/2014 |

OTHER PUBLICATIONS

Extended European Search Report issued Nov. 4, 2022 in corresponding European Patent Application No. 20762916.3.

* cited by examiner

PLASTIC CAP

TECHNICAL FIELD

This invention relates to a plastic cap for a threaded bottle with vents. More specifically, the invention relates to a plastic cap which can exhibit tamper-evident properties reliably even when applied to the mouth of a container having variations in dimensional accuracy.

BACKGROUND ART

As a cap for a container filled with a liquid such as a beverage, wide use is made of a resin cap to be mounted on the mouth of the container by thread engagement. Widely used as such a resin cap is a cap in which a tamper-evident band (hereinafter referred to as a TE band) is formed at the lower end of a skirt of the cap via a breakable weakened portion in order to prevent misapplication.

An unsealing demonstrating function by the TE band is a function performed through the following mechanism: When the cap is turned for unsealing, the body of the cap is raised, while the TE band engages the container mouth, and its ascent is suppressed. As a result, the breakable weakened portion is broken, whereupon the TE band is cut off from the cap body and remains on the container mouth. Thus, only the cap body is removed from the container mouth, demonstrating that the cap has been once unsealed.

In order for the TE band to exhibit a reliable unsealing demonstrating function, it is important that the turning angle of the cap at which the weakened portion between the cap body and the TE band is broken (this angle may hereinafter be referred to as "bridge break angle") be smaller than the turning angle of the cap at which the sealability of the container is released (this angle may hereinafter be referred to as "seal break angle").

If a plastic container, to which such a TE band is applied, is filled with contents having an autogenous pressure, such as a carbonated beverage, or is even filled with contents having no autogenous pressure, such as a non-carbonated beverage, under aseptic conditions, hot pack conditions or the like after a liquid nitrogen drip-feed step for replacing air in a head space within the container by nitrogen, internal pressure is exerted on the interior of the container. To relieve the internal pressure efficiently by turning the cap up to the seal break angle, therefore, a vent is formed in the container mouth, that is, an axial notch is formed in a screw of the container mouth (Patent Document 1).

As a container lid to be applied to aseptic filling, a proposal has been made for a container lid comprising a top panel wall, and a skirt wall extending downward from the peripheral edge of the top panel wall, wherein an inner cylindrical sealing piece (inner ring) and an outer cylindrical sealing piece (outer ring) are provided on the inner surface of the top panel wall; the outer peripheral surface of the inner cylindrical sealing piece extends out downward in a radially outwardly inclined manner at an inclination angle θ1 with respect to the central axis of the container lid, and then extends out downward in an inwardly inclined manner; an upper part of the inner peripheral surface of the inner cylindrical sealing piece extends out downward in a radially outwardly inclined manner at a larger angle θ3 than the inclination angle θ1 with respect to the central axis; the wall thickness of the inner cylindrical sealing piece gradually decreases downwardly; and the outer cylindrical sealing piece extends out downward in a radially outwardly inclined manner with respect to the central axis of the container lid (Patent Document 2).

PRIOR ART DOCUMENTS

Patent Documents

Patent Document 1: JP-A-2004-338789
Patent Document 2: Japanese Patent No. 4098797

SUMMARY OF THE INVENTION

Problems to be Solved by the Invention

When a cap with a TE band is applied to a container provided with notches in its screw for forming a vent on the container mouth, however, it has been found that a seal break may occur at a smaller angle than an expected seal break angle. The present inventor and others have closely investigated such a container mouth, and have found the following facts: A difference in the amount of resin shrinkage due to molding strain such as sink marks arises near the inner surface of the container mouth corresponding to a part where the notch is formed in the thread of the screw for formation of the vent, and a part where no notch is formed in the thread (ordinary thread). Such an inner surface of the container mouth is a site to be contacted by the inner ring of the cap for ensuring the sealability of the container, and the above difference in the amount of shrinkage at that site results in the generation of irregularities. These irregularities, if generated at a seal point ascribed to the inner ring, lead to the occurrence of a part which the inner ring fails to contact intimately. Hence, the sealability of the container is liable to be released at a smaller angle than the desired seal break angle.

It is an object of the present invention, therefore, to provide a plastic cap to be applied to a container having a screw formed with a vent, wherein a seal point of an inner ring with respect to a mouth of the container and a seal point of an outer ring with respect to the container mouth are switched during an unsealing step, whereby reliable sealability can be shown even when the plastic cap is applied to the container having poor dimensional accuracy and, if a TE band is present, a seal break is reliably achieved after a bridge break, so that excellent TE properties can be manifested.

Means for Solving the Problems

According to the present invention, there is provided a plastic cap to be applied to a mouth of a resin container having a screw formed with a vent, the vent comprising notches and extending axially, the plastic cap comprising a top plate section and a skirt section suspending from the top plate section, wherein an outer ring for sealing at least the outer surface of the mouth of the container, and an inner ring for sealing the inner surface of the mouth of the container are formed on the inner surface of the top plate section, while a screw is formed on the inner surface of the skirt section; the inner surface of the outer ring has a shape inclined toward the interior of the cap and, in a closed state, at least a seal point on the inner surface of the outer ring is pressure-contacted with the outer surface of the mouth of the container, whereby sealability is maintained; and in an unsealing step, a seal point on the outer surface of the inner ring is shifted into a pressure-contacted state on the inner surface of the mouth of the container located above a starting point of the screw of the mouth of the container before a seal by the outer ring is released, whereby sealability is maintained.

In the plastic cap of the present invention, the following features are preferred:

1. The seal point of the inner ring is an outermost diameter portion bulging outwardly, whereas the seal point of the outer ring is an innermost diameter portion at the lower end of the inner surface inclined downward.

2. A contact ring which contacts the leading end of the mouth of the container is formed between the outer ring and the inner ring.

3. A tamper-evident band is formed at the lower end of the skirt section via a breakable weakened portion and, after the breakable weakened portion is broken, a seal by the inner ring is released.

4. The seal point of the inner ring in the closed state is at a position on the inner surface of the mouth of the container corresponding to the notch formed first in a path beginning at the starting point of the screw formed on the outer surface of the mouth of the container and heading in the direction of threading.

5. If it is assumed that the axial length from the upper end of the notch formed in a threaded part of the screw at an uppermost level of the resin container to the leading end of the mouth of the container is W, a distance for which the cap ascends from the closed state until release of sealing by the outer ring is X, a distance for which the cap ascends from the closed state until breakage of the weakened portion is Y, and a distance for which the cap ascends from the closed state until a seal break is Z, the following formulas $Y<Z$ and $X>(Z-W)$ are satisfied.

6. The resin container is a resin container for aseptic filling, whose mouth is amorphous and in which nitrogen is enclosed after contents are filled into the container.

Effects of the Invention

With the plastic cap of the present invention, at the time of initial unsealing of the cap, the seal point between the cap and the container mouth is switched from that of the seal by the outer ring to that of the seal by the inner ring in conformity with the turning angle of the cap. By so doing, even when the cap is applied to a container inferior in dimensional accuracy, sealability can be ensured reliably.

If the plastic cap has a TE band, moreover, the seal break is sure to occur subsequently to the bridge break, thus enabling excellent TE properties to be exhibited.

MODE FOR CARRYING OUT THE INVENTION

For the plastic cap of the present invention, the following are important features: The outer ring has a shape inclined toward the interior of the cap. In the closed state, sealability is maintained at least by the outer ring. The seal point of the inner ring after the seal by the outer ring is released is located above the starting point of the screw of the container mouth.

As stated earlier, the inner surface of the container mouth, which corresponds to parts where notches are formed in the screw of the container mouth for the purpose of forming a vent in the screw, may be formed with irregularities. According to the present invention, however, even if the inner ring contacts the inner surface portion of the container mouth where the irregularities may occur, sealability is ensured by the outer ring. After sealing by the outer ring is released, on the other hand, a seal point is produced by the inner ring which lies at a position above the starting point of the screw of the container mouth, namely, at a position on the inner surface of the container mouth where there is no risk of irregularity formation. Hence, even if irregularities are formed on the inner surface of the container mouth corresponding to the parts where the notches are formed in the screw, reliable sealability is ensured.

The present invention will be described below based on the accompanying drawings.

Figure 1:
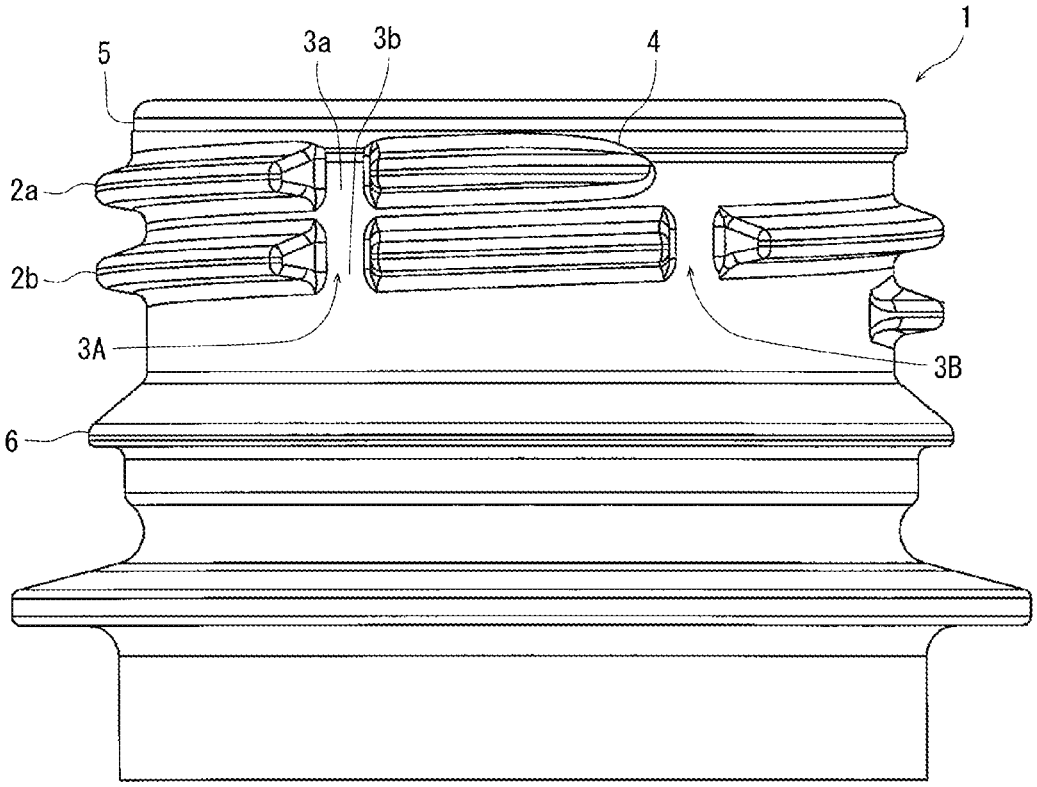
FIG. 1 is a side view showing an example of the mouth of a container having a screw provided with a vent to which the cap of the present invention is applied.

FIG. 1 is a side view showing an example of the mouth of a resin container to which the plastic cap of the present invention is applied. A screw 2 of the mouth 1 of the container has notches 3*a*, 3*b* provided in a threaded part 2*a* at an upper level and a threaded part 2*b* at a lower level, respectively, to form a vent 3A extending axially. Here, the mouth of the container has two vents (not shown) except for the illustrated vents 3A, 3B, and the four vents in total are formed. In the container mouth of this configuration, protrusions ascribed to the threaded parts and depressions ascribed to the notches are formed on the outer surface of the container mouth simultaneously with the molding of the container. The container mouth corresponding to the protrusions of the threaded parts is thick-walled and has large sink marks, and the inner surface of the container mouth tends to have a large inner diameter. In contrast, the container mouth corresponding to the depressions of the notches, as compared with the protrusions, is thin-walled and has small sink marks, and the inner surface of the container mouth tends to have a small inner diameter. Thus, irregularities tend to occur in the neighborhood of the inner surface of the container mouth corresponding to the notches.

A step 5 associated with a parting line produced during container molding is formed on an outer surface near the leading end of the container mouth.

An engaging projection 6 for engagement with flap pieces formed on the inner surface of the TE band of the cap is formed in a lower part of the container mouth.

Figure 2:
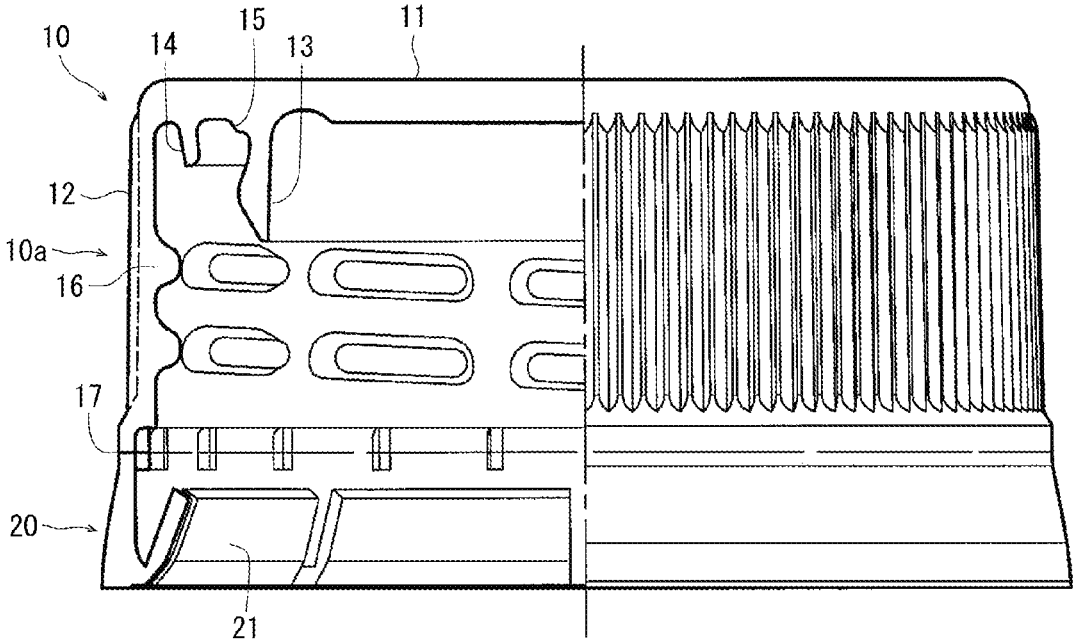
FIG. 2 is a half-side half-sectional view of an example of the cap of the present invention.

FIG. 2 is a view showing an example of the plastic cap according to the present invention, the right half of the view being a side view, and the left half of the view being a side sectional view.

The plastic cap of the present invention, indicated entirely at 10, comprises a cap body 10*a* composed of a top plate section 11, and a skirt section 12 suspending from the peripheral edge of the top plate section 11; and a TE band 20 molded integrally with the cap body 10*a* via a weakened portion 17. The top plate section 11 is formed with an inner ring 13 for contacting the inner surface 1*a* of the container mouth 1 to ensure sealability; an outer ring 14 for contacting the outer surface 1*b* of the container mouth; and a contact ring 15 formed between the inner ring 13 and the outer ring 14, and located outwardly of the base of the inner ring 13, for making contact with the leading end 1*c* of the container mouth. In the skirt section 12, a screw 16 is formed for engaging the screw 2 formed in the container mouth. On the inner surface of the TE band 20, a plurality of flap pieces 21 extending upward from the lower end are formed.

Figure 3:
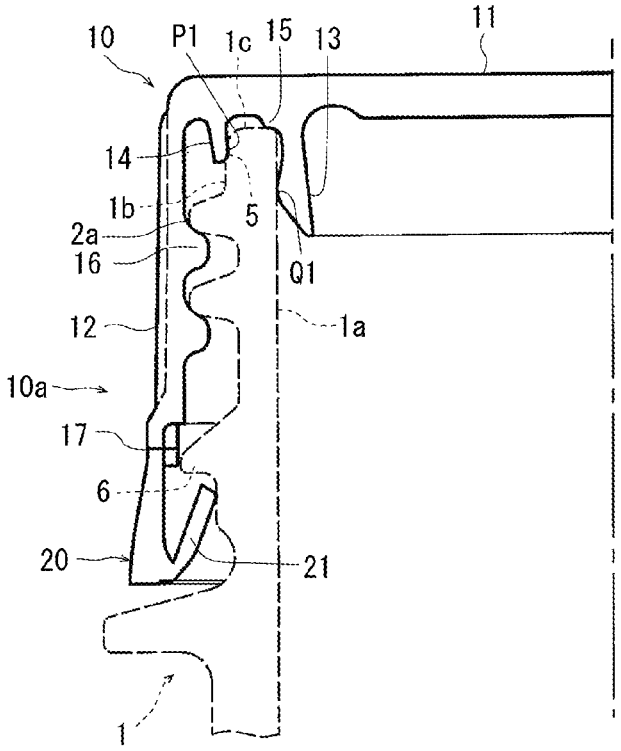
FIG. 3 is a side sectional view showing a state in which the example of the cap of the present invention shown in FIG. 2 is applied to the container mouth having the screw provided with the vent which is shown in FIG. 1.

FIG. 3 is a side sectional view showing a state in which the plastic cap shown in FIG. 2 is applied to the container mouth shown in FIG. 1.

In the present invention, the inner surface of the outer ring 14 has a shape inclined toward the interior of the cap. As shown in FIG. 3, therefore, the inner surface and the outer surface of the outer ring 14 are in pressure contact with the outer surface 1*b* of the container mouth as if embracing the outer surface 1*b* from outside, so that an innermost diameter portion at the lower end of the inner surface of the outer ring 14 serves as a seal point P1. In a closed state, sealability between the container mouth 1 and the cap 10 is ensured by the seal point P1 ascribed to the outer ring 14.

In this state, moreover, a seal point Q1 of an outermost diameter portion of the outer side surface of the inner ring 13 makes intimate contact with the inner surface 1*a* of the container mouth downwardly of the seal point P1 of the outer ring 14 and in the neighborhood of the threaded part 2*a* at the upper level in the container mouth (concretely, at a position on the inner surface of the container mouth corresponding to the notch 3*a* formed first in a path beginning at a starting point 4 of the screw of the container mouth 1 shown in FIG. 1 and heading in the direction of threading). The location of the inner surface 1*a* of the container mouth intimately contacted by the seal point Q1 of the inner ring 13 is in the vicinity of the threaded part 2*a*. Thus, there is a possibility for the occurrence of irregularities at this location of the surface. In the cap of the present invention, as mentioned above, the inner surface of the outer ring 14 has a shape inclined inward. Even if the sealability by the seal point Q1 of the inner ring 13 fails to be ensured, therefore, the sealability is ensured by the seal point P1 of the outer ring 14. Furthermore, the contact ring 15 also makes intimate contact with the leading end 1*c* of the container mouth. Consequently, the cap intimately contacts the container mouth at least at the two points of the outer ring 14 and the contact ring 15, thereby ensuring the sealability.

Figure 4:
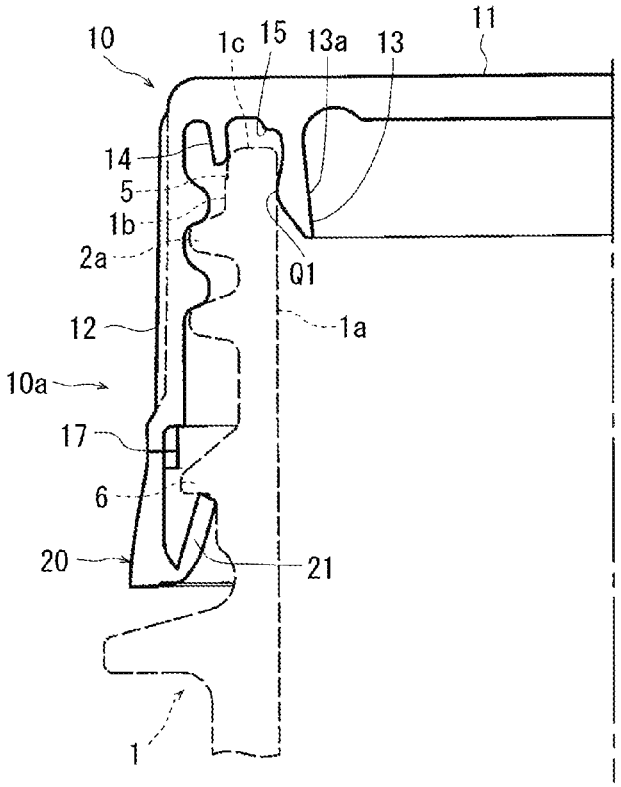
FIG. 4 is a side sectional view showing a state in which the cap is turned for unsealing the container mouth having the cap applied thereto shown in FIG. 3, whereby the release of a seal by an outer ring is started.

FIG. 4 is a side sectional view showing a state in which the cap is turned in an unsealing direction from the closed state shown in FIG. 3, whereby the seal by the outer ring 14 is released.

When the cap 10 is turned for unsealing, and begins to move upward, the contact ring 15 first leaves the leading end 1*c* of the container mouth. Then, the pressure contact between the seal point P1 of the outer ring 14 and the outer surface 1*b* of the container mouth is released. In this state, the seal point Q1 of the inner ring 13 is in pressure contact with the inner surface 1*a* of the container mouth above the starting point 4 of the threaded part 2*a* of the container mouth. That is, the seal point Q1 of the inner ring 13 maintains the intimate contact state while moving upward, during the unsealing step beginning in the closed state of FIG. 3 and ending in the state of release of seal by the outer ring 14 in FIG. 4. In the state of FIG. 4, moreover, the seal point Q1 makes pressure contact with a thread-free region located above the inner surface region, where irregularities may have been generated, in the inner surface 1*a* of the container mouth. Hence, reliable sealability by the inner ring 13 is ensured.

The inner ring 13 also has a straight-line portion 13*a* suspending from the top plate section 11, and the outer surface of the inner ring 13 bulges out in an arcuate form, whereby the seal point Q1 makes intimate contact with the form of the inner surface 1*a* of the container mouth. Thus, the straight-line portion 13*a* elastically deforms in accordance with the seal point Q1.

Figure 5:
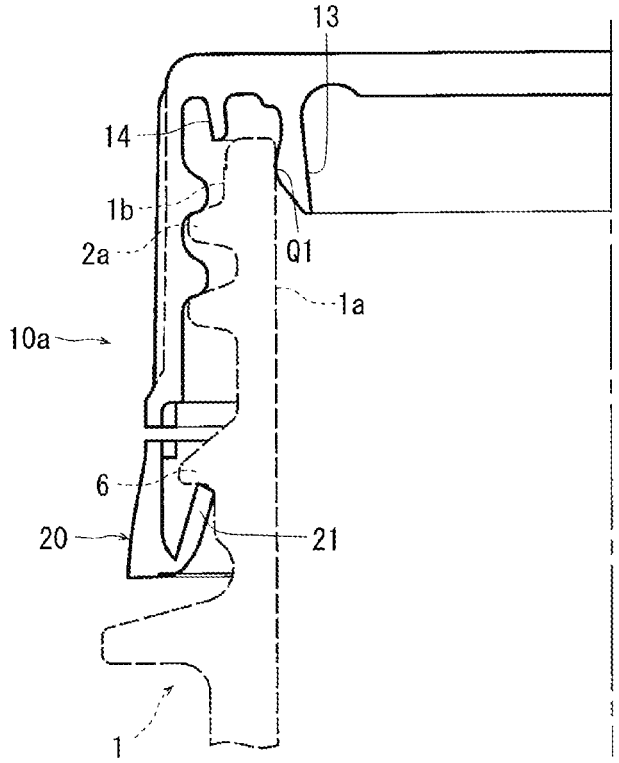
FIG. 5 is a side sectional view showing a state in which the cap is further turned from the state shown in FIG. 4, whereby a weakened portion connecting together a skirt section of the cap and a TE band is broken.

FIG. 5 is a side sectional view showing a state in which the cap 10 is further turned in the unsealing direction from the state of release of the sealing by the outer ring 14 shown in FIG. 4, whereby the weakened portion 17 connecting the cap body 10*a* and the TE band 20 together is broken (bridge break). That is, as the turning of the cap for unsealing proceeds, the TE band 20, whose flap pieces 21 are in engagement with the engaging projection 6 of the container mouth, cannot follow the ascent of the cap body 10*a*. Thus, the breakable weakened portion 17 is broken (bridge break). In this state, the outer ring 14 does not contact the container mouth, but the seal point Q1 of the inner ring 13 is in pressure contact with the thread-free region where no thread of the container mouth is formed, namely, the site of the inner surface 1*a* of the container mouth where no irregularities are formed. Thus, reliable sealability is maintained.

Figure 6:
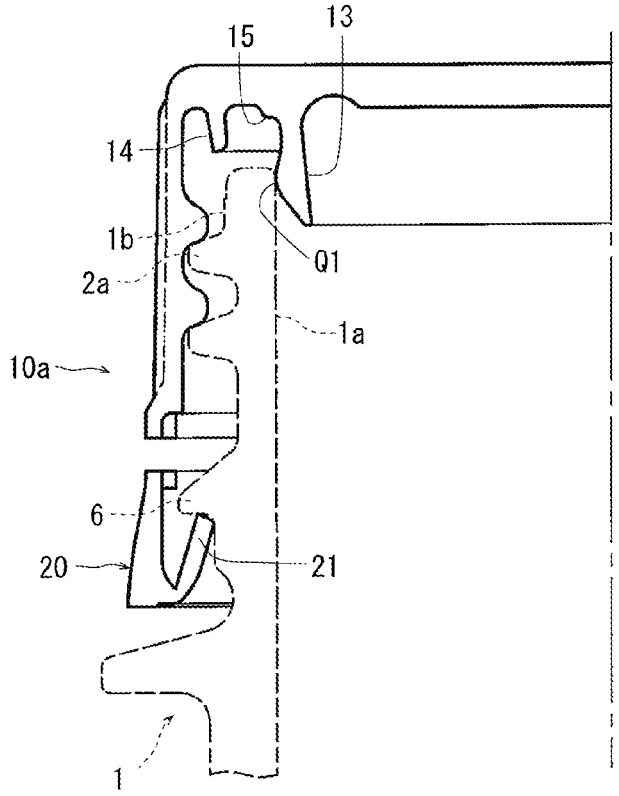
FIG. 6 is a side sectional view showing a state in which the cap is further turned from the state shown in FIG. 5, whereby the release of a seal by an inner ring is started.

FIG. 6 is a side sectional view showing a state in which the cap is further turned in the unsealing direction from the state of division of the weakened portion 17 of the TE band 20 shown in FIG. 5, whereby the seal point Q1 of the inner ring 13 is separated from the inner surface 1*a* of the container mouth (seal break). The seal point Q1 of the inner ring 13 makes no contact any more with the site of the inner surface 1*a* of the container mouth corresponding to the thread-free region. At this very point of time, the sealability of the container is released (seal break).

With the plastic cap of the present invention, it is important that in the closed state, the outer ring be capable of ensuring sealability. The length of the outer ring that fulfills this condition varies with the shape of the mouth of the container to which the cap is to be applied. Preferably, however, the outer ring has a length of 1.0 to 1.6 mm. The angle of inclination of the inner surface of the outer ring toward the interior of the cap (the angle with respect to the axial direction) is preferably 10° or less, especially 4 to 10°.

For the container mouth according to the present invention, the turning angle of the cap during initial unsealing varies with the pitch or the like of the screws of the container mouth and the cap. In the case of a resin container of a generally distributed size, the turning angle is 120 to 180 degrees, and the vertical axial height is 0.3 to 0.6 mm, for a turn from the closed state of FIG. 3 to the state of FIG. 4; the turning angle is 190 to 230 degrees, and the vertical axial height is 1.0 to 1.4 mm, for a turn from the state of FIG. 3 to the state of FIG. 5; and the turning angle is 270 to 310 degrees, and the vertical axial height is 1.8 to 2.2 mm, for a turn from the state of FIG. 3 to the state of seal break in FIG. 6.

In a PCO-1881 bottle (outer diameter of the mouth: 28 mm, pitch of the screw: 2.7 mm), a general container as a polyester bottle, the turning angle is set to be about 150 degrees for a turn from the sealed state of FIG. 3 to the state of FIG. 4, about 60 degrees for a turn from the state of FIG. 4 to the state of FIG. 5, and about 80 degrees for a turn from the state of FIG. 5 to the state of seal break in FIG. 6. By not forming the notch that should be formed in the threaded part at the uppermost level where the vent 3A, which is first formed in the path beginning at the starting point of the screw and heading in the direction of threading, is to be formed, the inner surface of the container is smoothly formed at the turning angle after the release of the seal by the outer ring, but before the seal break. Thus, sealing by the inner ring can be performed reliably.

The site of the inner surface of the container mouth, which the inner ring contacts and where the irregularities attributed to the difference in the amount of resin shrinkage occur, is a site 1.7 mm or more below the upper end of the container mouth. In the state of FIG. 3, the inner ring intimately contacts a site 1.8 to 2.2 mm below the upper end of the container mouth. When turned to the state of FIG. 4, the cap 10 moves upwards by 0.3 to 0.6 mm. During its turn from the state of FIG. 3 to the state of FIG. 4, therefore, the seal point Q1 of the inner ring 13 moves to a site with a smaller difference in the wall thickness and a smaller difference in the rate of resin shrinkage in the inner surface of the container, and makes pressure contact with the site. Afterwards, the cap 10 is turned from the state of FIG. 4 until the weakened portion breaks. At this time, the cap 10 ascends from the state of the closed state of FIG. 3 by 1.0 to 1.4 mm. The cap 10, i.e., the seal point Q1 of the inner ring 13, ascends by 1.8 to 2.2 mm from the closed state of FIG. 3 until the seal break of FIG. 6.

Figure 7:
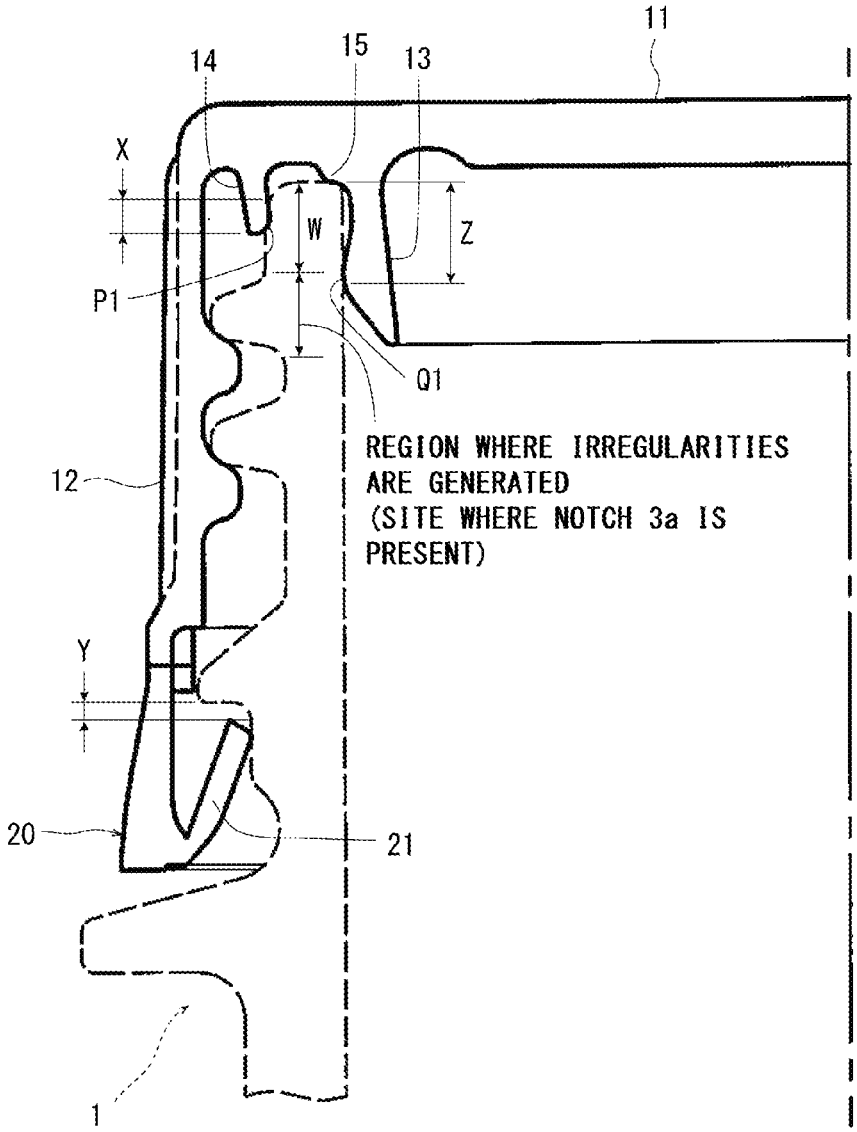
FIG. 7 is a view for illustrating the preferred dimensions of the inner ring and the outer ring provided in the cap of the present invention.

Let the axial length from the upper end of the above-mentioned site of the inner surface of the container mouth, which the inner ring contacts and where the irregularities attributed to the difference in the amount of resin shrinkage occur (i.e., the upper end of the notch formed in the threaded part at the uppermost level), to the upper end of the container mouth be W; the distance for which the cap 10 ascends from the closed state of FIG. 3 to the state of release of the sealing by the outer ring in FIG. 4 be X; the distance for which the cap 10 ascends from the closed state of FIG. 3 to the state of breakage of the weakened portion 17 in FIG. 5 be Y; and the distance for which the cap 10 ascends from the closed state of FIG. 3 to the state of the seal break in FIG. 6 be Z. Then, the relationships $Y<Z$ and $X>Z-W$ hold. The distances W, X, Y and Z are shown in FIG. 7.

The plastic cap of the present invention uses, for example, a thermoplastic resin, such as low, medium or high density polyethylene, linear low density polyethylene, isotactic polypropylene, syndiotactic polypropylene, poly-1-butene, poly-4-methyl-1-pentene, random or block copolymer of α-olefins such as ethylene, propylene, 1-butene, or 4-methyl-1-pentene, ethylene-vinyl acetate copolymer, ethylene-(meth)acrylic acid copolymer, ethylene-(meth)acrylate copolymer, or ion crosslinked olefin copolymer (ionomer). The plastic cap can be molded, for example, by compression molding or injection molding.

INDUSTRIAL APPLICABILITY

The plastic cap of the present invention can be used for a resin container formed with a vent mechanism, in which a screw and a notch constituting a vent are formed simultaneously with the molding of the mouth of the container, so that irregularities due to molding strain such as sink marks are apt to occur in the inner surface of the mouth of the container.

Such a resin container formed with a vent mechanism is put to a use for filling contents having an autogenous pressure, such as a carbonated beverage, and a use such as aseptic filling or hot packing (hot filling). In the present invention, in particular, the resin container can be put suitably to a use such as aseptic filling using a polyethylene terephthalate bottle having an uncrystallized mouth.

EXPLANATIONS OF LETTERS OR NUMERALS

1 container mouth; 2 screw; 3A, 3B vents; 3*a*, 3*b* notches; 4 starting point of screw; 5 step; 6 engaging projection; 10 cap; 11 top plate section; 12 skirt section; 13 inner ring; 14 outer ring; 15 contact ring; 16 screw; 17 weakened portion; 20 TE band; 21 flap piece.

The invention claimed is:

1. A kit comprising:

a resin container having a mouth with a screw formed with a vent, the vent comprising notches and extending axially; and a plastic cap to be applied to the mouth of the resin container, wherein the plastic cap comprises a top plate section and a skirt section suspended from the top plate section, an outer ring for sealing at least an outer surface of the mouth of the resin container and an inner ring for sealing an inner surface of the mouth of the resin container are formed on an inner surface of the top plate section, and a screw is formed on an inner surface of the skirt section, an inner surface of the outer ring has a shape inclined toward an interior of the plastic cap and, in a closed state, at least a seal point on the inner surface of the outer ring is pressure-contacted with the outer surface of the mouth of the resin container, whereby sealability is maintained, in an unsealing step, a seal point on an outer surface of the inner ring is shifted into a pressure-contacted state on the inner surface of the mouth of the resin container at a location above a starting point of the screw of the mouth of the resin container before a seal by the outer ring is released, whereby sealability is maintained, and the seal point of the inner ring in the closed state is at a position on the inner surface of the mouth of the resin container corresponding to one of the notches that is formed on a path beginning at the starting point of the screw formed on the outer surface of the mouth of the resin container and heading in a direction of threading.

2. The kit according to claim 1, wherein the seal point of the inner ring is an outermost diameter portion bulging outwardly, and the seal point of the outer ring is an innermost diameter portion at a lower end of the inner surface of the outer ring inclined downward.

3. The kit according to claim 1, wherein a contact ring which contacts a leading end of the mouth of the resin container is formed between the outer ring and the inner ring.

4. The kit according to claim 1, wherein a tamper-evident band is formed at a lower end of the skirt section via a breakable weakened portion and, after the breakable weakened portion is broken, a seal by the inner ring is released.

5. The kit according to claim 1, wherein if it is assumed that an axial length from an upper end of one of the notches that is formed in a threaded part of the screw at an uppermost level of the resin container to a leading end of the mouth of the resin container is W, a distance for which the plastic cap ascends from the closed state until release of sealing by the outer ring is X, a distance for which the plastic cap ascends from the closed state until breakage of a breakable weakened portion is Y, and a distance for which the plastic cap ascends from the closed state until a seal break is Z, the following formulas $$Y<Z \text{ and } X>(Z-W)$$

are satisfied.

6. The kit according to claim 1, wherein the resin container is a resin container adapted for aseptic filling.

7. The kit according to claim 2, wherein a contact ring which contacts a leading end of the mouth of the resin container is formed between the outer ring and the inner ring.

8. The kit according to claim 2, wherein a tamper-evident band is formed at a lower end of the skirt section via a breakable weakened portion and, after the breakable weakened portion is broken, a seal by the inner ring is released.

9. The kit according to claim 3, wherein a tamper-evident band is formed at a lower end of the skirt section via a breakable weakened portion and, after the breakable weakened portion is broken, a seal by the inner ring is released.

10. The kit according to claim 2, wherein if it is assumed that an axial length from an upper end of one of the notches that is formed in a threaded part of the screw at an uppermost level of the resin container to a leading end of the mouth of the resin container is W, a distance for which the plastic cap ascends from the closed state until release of sealing by the outer ring is X, a distance for which the plastic cap ascends from the closed state until breakage of a breakable weakened portion is Y, and a distance for which the plastic cap ascends from the closed state until a seal break is Z, the following formulas $$Y<Z \text{ and } X>(Z-W)$$

are satisfied.

11. The kit according to claim 3, wherein if it is assumed that an axial length from an upper end of one of the notches that is formed in a threaded part of the screw at an uppermost level of the resin container to a leading end of the mouth of the resin container is W, a distance for which the plastic cap ascends from the closed state until release of sealing by the outer ring is X, a distance for which the plastic cap ascends from the closed state until breakage of a breakable weakened portion is Y, and a distance for which the plastic cap ascends from the closed state until a seal break is Z, the following formulas $$Y<Z \text{ and } X>(Z-W)$$

are satisfied.

12. The kit according to claim 4, wherein if it is assumed that an axial length from an upper end of one of the notches that is formed in a threaded part of the screw at an uppermost level of the resin container to a leading end of the mouth of the resin container is W, a distance for which the plastic cap ascends from the closed state until release of sealing by the outer ring is X, a distance for which the plastic cap ascends from the closed state until breakage of the breakable weakened portion is Y, and a distance for which the plastic cap ascends from the closed state until a seal break is Z, the following formulas $$Y<Z \text{ and } X>(Z-W)$$

are satisfied.

13. The kit according to claim 2, wherein the resin container is a resin container for aseptic filling, the mouth of the resin container is amorphous, and the resin container has nitrogen enclosed therein after contents are filled into the resin container.

14. The kit according to claim 3, wherein the resin container is a resin container for aseptic filling, the mouth of the resin container is amorphous, and the resin container has nitrogen enclosed therein after contents are filled into the resin container.

15. The kit according to claim 4, wherein the resin container is a resin container for aseptic filling, the mouth of the resin container is amorphous, and the resin container has nitrogen enclosed therein after contents are filled into the resin container.

* * * * *